United States Patent [19]

Newman

[11] 4,266,353

[45] May 12, 1981

[54] DEVICE FOR PLOWING BALLAST

[75] Inventor: George R. Newman, West Columbia, S.C.

[73] Assignee: Canron Corporation, West Columbia, S.C.

[21] Appl. No.: 83,946

[22] Filed: Oct. 11, 1979

[51] Int. Cl.[3] ..... E01B 27/04

[52] U.S. Cl. ..... 37/105

[58] Field of Search ..... 104/2, 5, 279; 37/30, 37/104, 105

[56] References Cited

U.S. PATENT DOCUMENTS

| | | | |
|---|---|---|---|
| 3,491,467 | 1/1970 | Finger | 37/104 |
| 3,605,297 | 9/1971 | Kershaw | 37/105 |

*Primary Examiner*—Richard A. Bertsch

*Attorney, Agent, or Firm*—Wenderoth, Lind & Ponack

[57] ABSTRACT

There is disclosed a mobile machine for plowing railroad ballast. Mounted centrally of the machine between the front and rear axles thereof and beneath the main chassis of the machine are a pair of plow blades. The plow blades are each mounted on an individual sub-frame which is capable of being raised and lowered so that each plow blade may be brought into engagement with the ballast and lifted therefrom for track travel. Each plow blade carries a rail embracing tunnel. A pivotal connection including a parallelogram linkage connects both tunnel and plow blade to their respective sub-frames such that the blades can be moved through a wide arc in a vertical plane, their tunnels being capable of spanning the rails in each position adopted by the plow blades.

3 Claims, 4 Drawing Figures

DEVICE FOR PLOWING BALLAST

BACKGROUND OF THE INVENTION

There has been an increasing requirement amongst railroads of the world to provide rail spanning tunnel devices on railroad track ballast plows. In the past it has only been necessary to plow designers to ensure that the plow blade itself, where it spans the rail of the track should have an aperture large enough to pass the rail through the plow blade in all positions of operation of the plow blade. With the requirement to replace the simple aperture with a tunnel device, engineers have been faced with an additional complexity in designing plows of high versatility.

The present invention seeks to provide a versatile plow device which can operate with a tunnel device.

SUMMARY OF THE INVENTION

According to the present invention there is provided a railroad ballast plow comprising a wheeled chassis; a pair of plow blade means each pivotally mounted on a frame means centrally of said chassis for pivotal movement about a substantially vertical axis, each plow blade means extending outwardly from its pivotal mount; longitudinally extending tunnel means for covering each track rail, pivotally mounted on, and carried by, its respective plow blade means; and means to pivot each blade means relative to said chassis and on its tunnel means, to adopt a plurality of ballast plowing configurations. Preferably the said frame means comprises a pair of sub-frames located beneath the chassis of the vehicle centrally thereof, each sub-frame carrying the plow blade means for one side of the track, the tunnel means for that side of the track and the means for pivoting that plow blade. Conveniently the means for pivoting the plow blade means comprises a parallelogram linkage connecting the tunnel and its respective sub-frame and includes pivotal connections between the plow blade means and its respective sub-frame and tunnel.

BRIEF DESCRIPTION OF THE DRAWINGS

The following is a description, by way of example, of one embodiment of the present invention reference being had to the accompanying drawings in which.

BRIEF DESCRIPTION OF THE PREFERRED EMBODIMENT

Figure 1:
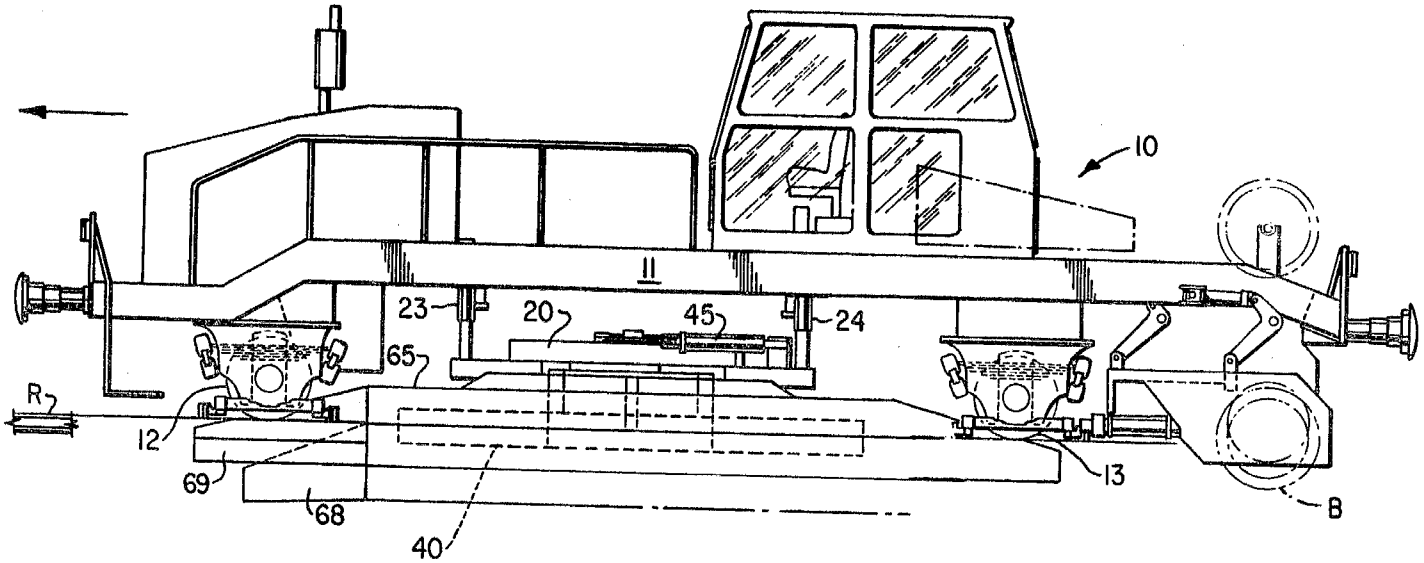
FIG. 1 is a side elevation of the machine showing diagramatically one of the plow blade means mounted on its sub-frame.
Figure 2:
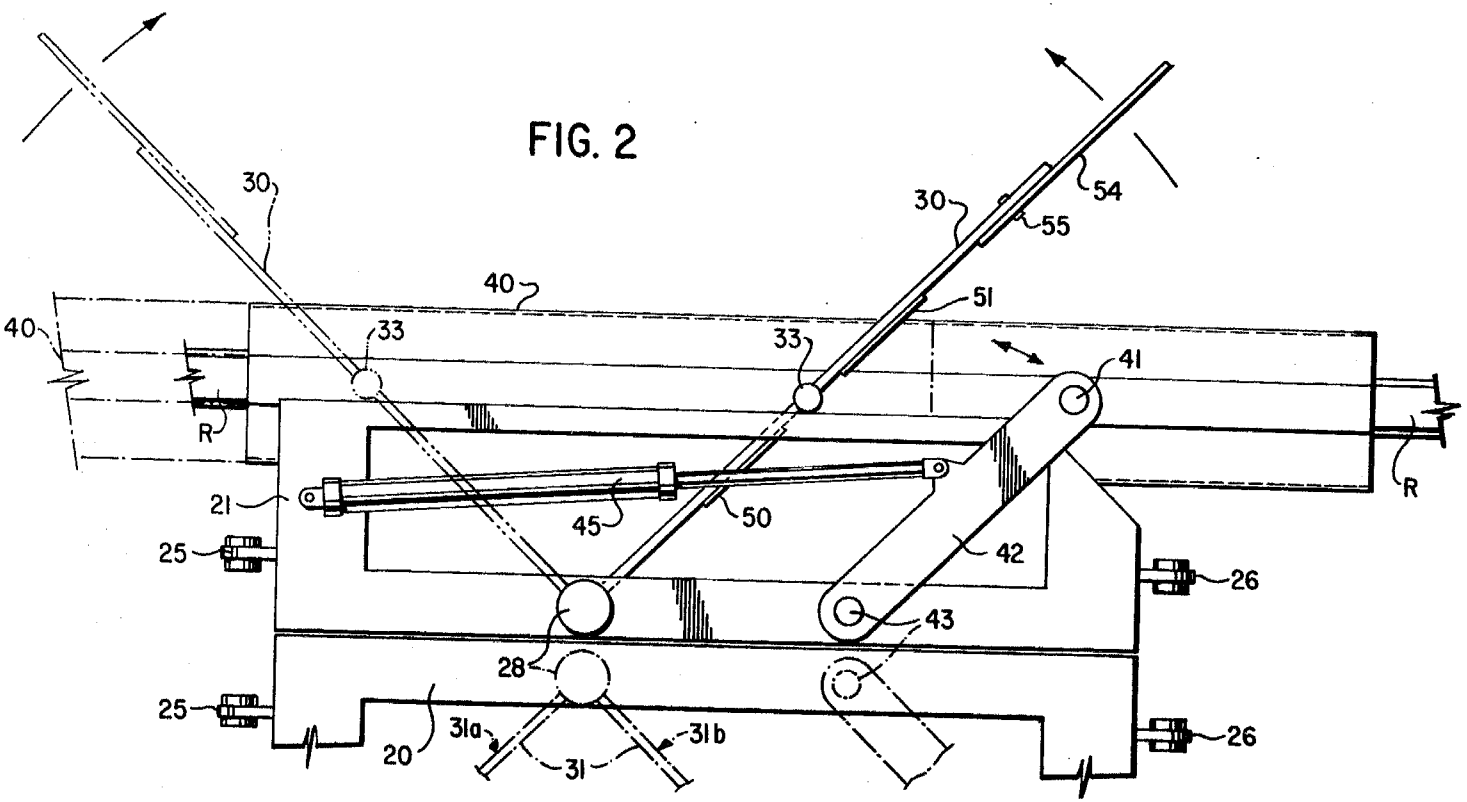
FIG. 2 is a partial plan view showing a sub-frame its associated plow blade means and its associated tunnel and the means for moving the plow blade relative to the sub-frame.
Figure 3:
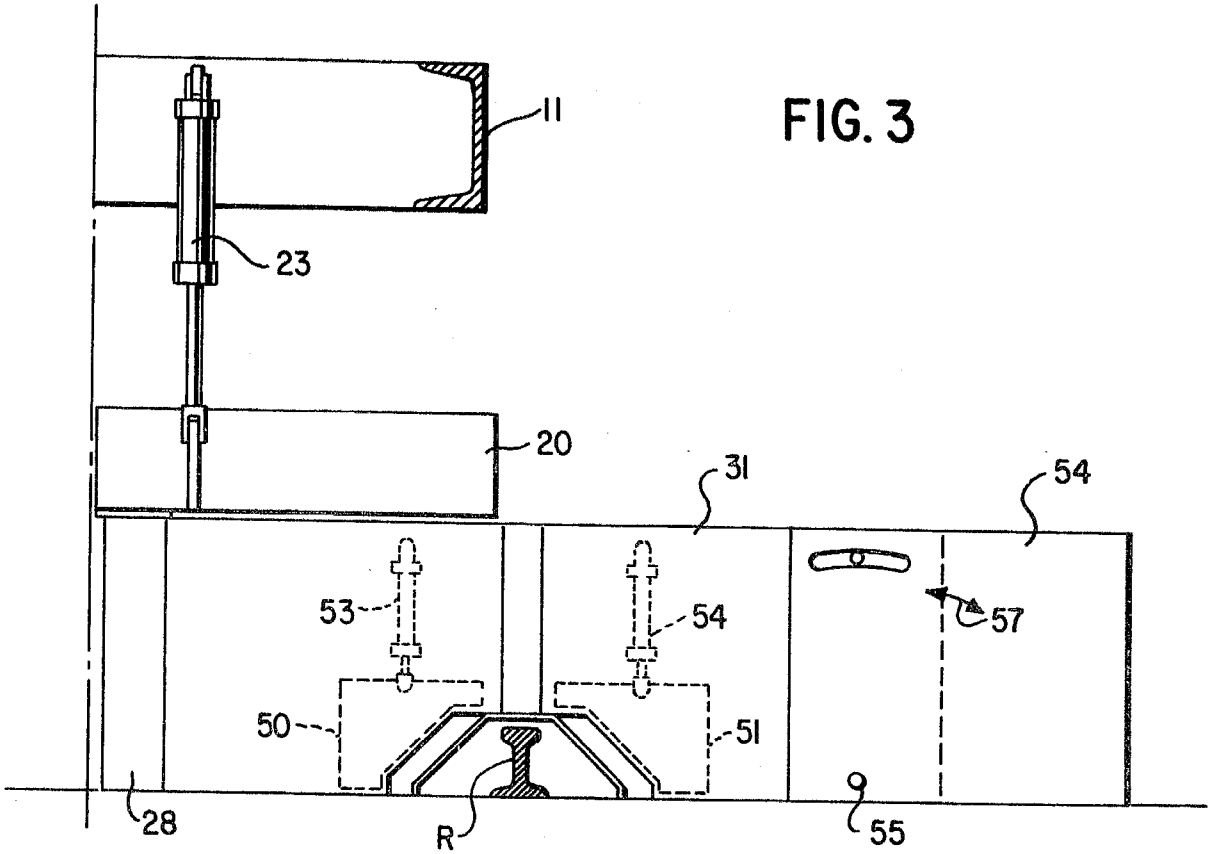
FIG. 3 is a partial end view showing one of the plow blade means, its associated tunnel and the associated sub-frame.

A self propelled railroad ballast plow machine 10 has a main chassis 11 mounted on rail engaging wheels 12 and 13 on front and rear axles. Centrally located under the chassis 11 between the front and rear axles is a pair of sub-frames 20, 21 the left hand one 20 of which is seen in FIGS. 1 and 3, the right hand sub-frame 21 being shown in FIG. 2. The sub-frames 20, 21 are individually raised and lowered relative to the main chassis 11 by means of hydraulic cylinders 23, 24 attached at their upper ends to chassis 11 and at their other lower ends to lugs 25, 26. The cylinders 23, 24 for the right hand sub-frame 21 cannot be seen in FIG. 1 because they are behind the left hand cylinders 23, 24. Pivotally mounted on the sub-frame 20 is the center plow 31 and pivotally mounted on sub-frame 21 is center plow 30. In FIG. 2 the plow 30 is shown extending rearwardly, that is to say from its vertical pivot 28 outwardly and rearwardly, in full lines, and forwardly in dotted line, that is to say from the outer portion of the track inwardly towards the vertical pivot 28. The direction of the movement of the machine may be assumed to be that shown by the arrow in FIG. 1, although the self propelled machine 10 can move in either direction. Pivotally mounted on the plows 30, 31, at 33, are rail spanning tunnels 40. Also pivotally mounted to the tunnels 40 at 41 is a link 42 the other end of which is pivotally connected at 43 to the sub-frame. Since the sub-frame 20, 21, the plows 30, 31 and the means for pivoting are identical, only one assembly is shown in full in FIG. 2. It will be seen that the linkage produced by the portion of the plow 30 between its point of pivot 28 on the sub-frame and the point of pivot 33 to the tunnel 40, and the link 42 between its pivot point 43 to the sub-frame and the pivot point 41 to the tunnel 40, approximates closely to a parallelogram linkage. Extending between the sub-frame and the link 42 is a hydraulic piston and cylinder arrangement 45.

Contraction of the cylinder 45 pivots the link 42 from right to left as seen in FIG. 2 so that the plow 30 is moved from its full line, rearwardly directed position, to its dotted line, forwardly directed position, on the sub-frame 21 about its pivot point 28. The tunnel 40 being pivotally connected to the plow 30 at 33 and to the link 42 at 41, is translated longitudinally (see the dotted line position of tunnel 40) so that in either the full line, or dotted line, position of the plow 30, the tunnel 40 sits squarely astride a rail. As has been indicated, the other tunnel 40 connected to the sub-frame 20 is similarly translated because of identical mirror image connections. Normally the sub-frame on which the plow is to be mounted is first raised clear of the rail by the cylinders 23, 24 before the plow and tunnel are moved to a new position.

As best seen in FIG. 3 a pair of ballast passing guillotine type gates 50 and 51 operated by hydraulic cylinders 53, 54 are mounted on each plow 30, 31 one on either side of the tunnels 40. At the outer end of the plows 30, 31 there are provided flaps 54 pivoted at points 55 on the plows 30, 31 and movable in an arc (as depicted by the arrow 57 about the pivot point 55), preferably under manual operation, to provide a plow end configuration for dressing the outer part of the track.

Figure 4:
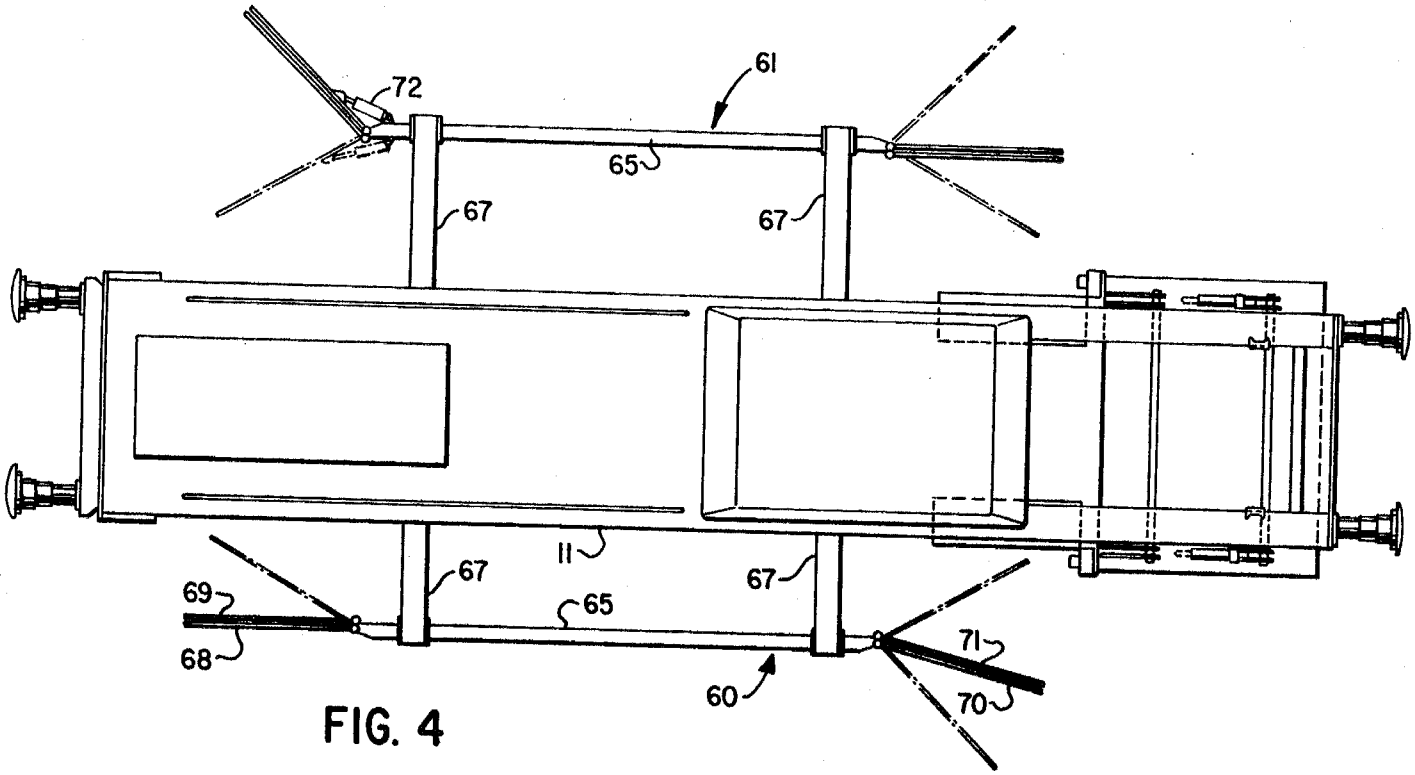
FIG. 4 is a plan view of the machine showing a suitable side plow device for use with the center plow means.

In FIG. 4 there are shown suitable side plows 60, 61 which conveniently may be provided for operation with the plows 30, 31, each of which side plows 60, 61 comprises a main plow board 65 telescopically and pivotally mounted on beams 67 to the chassis 11 of the machine 10 so that the plows 60, 61 can adopt a series of positions. Two operational positions are shown in FIG. 2 where the plow 60 is telescoped closer to the chassis 11 of the machine 10 than is the plow 61 which is telescoped somewhat farther outwardly of the chassis 11. The plows 60, 61 carry at leading and trailing edges a pair of flap members 68, 69:70, 71 which may be rotated by cylinders such as 72 to cooperate with the different configurations to be adopted by plows 30, 31.

Turning to FIG. 2 it will be noted that, in operation, the plow configuration to suit the mode of operation of the machine 10 is first selected, that is to say the plows 30, 31 are arranged to produce the result desired and the machine set in motion. For example, say that ballast has been dumped in the center of the track and it is desired to move the ballast outwardly to the outside of the track. With the machine moving from right to left as indicated in the arrow in FIG. 1, the plow 30 would be arranged in the full line position of FIG. 2 and the plow 31 would be arranged in the position 31*b*. A plow nose would be thus formed in the center of the machine with the plows 30, 31 extending outwardly on either side in the form of a wedge. As the machine is moved the plow nose will contact the ballast dumped in the center of the track, and force the ballast outwardly along the plows 30, 31 over the tunnels 40 and out to the edge of the track. If it is desired to dump a certain amount of ballast in the vicinity of the rails R for tamping purposes, then the gates 50 and/or 51 could be opened to a greater or lesser extent to provide for the passage of the required amount of ballast to the tamping area adjacent the rails R.

Similarly it is to be understood that if it is desired to move ballast from a dumped position on the left hand shoulder of the track across the track to the right hand shoulder of the track, then the plow 30 will be positioned in the full line configuration shown in FIG. 2 and the plow 31 on the other side of the machine will adopt the position numbered 31*a* in FIG. 2. Thus the plow in configuration 31*a* will encounter the ballast on the left hand shoulder and will move it over its tunnel 40 to the center of the machine 10 across the plow blade 30 over its tunnel 40 and out to the right hand side of the track.

For moving ballast from the right hand shoulder of the track to the left hand shoulder of the track, the plow 30 will assume the dotted line shown in FIG. 2 and the plow 31 on the other side will be arranged in the position shown 31*b*.

Obviously the plows 30, 31 are capable of performing a great number of operations and since the machine is normally capable of moving in either direction the versatility thereof is further enhanced. When utilized with side plows 60, 61 such as that shown in FIG. 4 (this side plow forming the subject matter of my co-pending U.S. patent application No. 83,945 filed Oct. 11, 1979 the disclosure of which is incorporated hereinto by reference) a really wide range of operations may be achieved.

A track broom B is mounted on the chassis 11 so that it may be moved into and out of engagement with the ballast.

What I claim as my invention is:

1. A railroad ballast plow comprising a wheeled chassis, a pair of plow blade means each pivotally mounted on a frame means located beneath and centrally of said chassis for pivotal movement about a substantially vertical axis, each plow blade means extending outwardly from its pivotal mount; longitudinally extending tunnel means for covering each track rail, pivotally mounted on and carried by its respective plow blade means; and means to pivot each blade means relative to said chassis and on its tunnel means, to adopt a plurality of ballast plowing configurations.

2. Apparatus as claimed in claim 1 in which said frame means comprises a pair of sub-frames located beneath said chassis, centrally thereof; each sub-frame carrying the plow blade means for one side of the track, the tunnel means for that side of the track and the means for pivoting that plow blade.

3. Apparatus as claimed in claim 2 in which the means for pivoting the plow blade means comprises a parallelogram linkage connecting the tunnel and its respective sub-frame and includes pivotal connections between the plow blade means and its respective sub-frame and tunnel.

* * * * *